United States Patent [19]

Naffziger

[11] 4,382,470

[45] May 10, 1983

[54] METHOD AND WELL CASING

[76] Inventor: Larry C. Naffziger, 3091 N. Monroe, Fresno, Calif. 93705

[21] Appl. No.: 282,395

[22] Filed: Jul. 13, 1981

[51] Int. Cl.[3] ..... E21B 43/00

[52] U.S. Cl. ..... 166/369; 166/105; 166/242

[58] Field of Search ..... 166/369, 54.1, 227, 166/236, 235, 105.1, 105.5, 105.6, 242, 261, 233, 105, 68, 74

[56] References Cited

U.S. PATENT DOCUMENTS

| | | | |
|---|---|---|---|
| 170,124 | 11/1875 | Spicer | 166/236 |
| 1,218,848 | 3/1917 | Foster | 166/236 |
| 1,652,650 | 12/1927 | Watson | 166/236 |
| 1,751,017 | 3/1930 | Sullivan | 166/105.5 |
| 2,158,393 | 4/1938 | Aulman | 166/105 |
| 2,346,602 | 4/1944 | O'Bannon | 166/105.5 |
| 2,884,761 | 5/1959 | Miles et al. | 166/236 |
| 2,973,819 | 3/1961 | Adams et al. | 166/236 |
| 2,978,033 | 4/1961 | Pitcher | 166/236 |

*Primary Examiner*—Stephen J. Novosad
*Assistant Examiner*—Joseph Falk
*Attorney, Agent, or Firm*—Huebner & Worrel

[57] ABSTRACT

A method and casing for a well in which the casing has a conduit formed by a substantially tubular wall defining an interior and an exterior for the conduit and having an opening extending through the wall to establish a path for fluid movement into the interior of the conduit, and a housing mounted on the exterior of the conduit having a chamber in communication with the opening of the conduit and the housing having an opening therein to establish a path for fluid movement into the chamber of the housing.

8 Claims, 3 Drawing Figures

METHOD AND WELL CASING

BACKGROUND OF THE INVENTION

1. Field Of The Invention

The present invention relates to a method and well casing and more particularly to such a method and well casing which substantially improve upon the productivity of which a well is capable ensuring that the well can be operated with an efficiency considerably beyond that which has heretofore been possible and having particular utility in fluid recovery from two or more fluid bearing formations simultaneously.

2. Description Of The Prior Art

A primary objective in the operation of wells of all types and particularly deep water wells is maintaining well production at the desired level. Another primary objective is reducing to a minimum the power required to maintain a given level of productivity for a well. In water wells, for example, it is known that where the aquifer is not sufficiently pressurized, it is extremely expensive to pump water from the well. This problem is compounded where the structure of the fluid bearing formation and/or the gravel pack about the well casing interefere with the influx of water from the upper portions of the aquifer. Where these conditions exist, productivity rapidly drops off and the cost of operation increases.

It has been found in these and other situations that, using conventional procedures, it is necessary to elevate or lower the pump assembly in the well to reposition the intake at a level such as to permit more efficient extraction from the specific fluid bearing formation involved. This can be extremely expensive and in some instances prohibitively so.

Another problem encountered in well operation exists where there are two or more superimposed fluid bearing formations. The formations are usually separated from each other by impervious rock strata. In a conventional casing if perforations were provided to communicate with more than the lower formation, fluid entering the perforations from the upper formations would entrap air. Such air causes rapid wearing of the pump and eventual destruction of it. It can also cause a pump assembly to lose its priming. Since this is unsatisfactory and since there is in such a condition little or no communication between the formations outside the casing, the formations must be tapped individually. This requires repositioning of the pump assembly within the well after one formation has been exhausted. Insofar as the applicant is aware, it has not heretofore been possible as a practical matter to pump simultaneously from two or more formations other than as may incidently occur from percolation from the upper formations to the lower formations. Such percolation is of an inconsequential amount and does not, as a practical matter, permit utilization of such upper formations.

Therefore, it has long been known that it would be desirable to have the capability of maintaining well productivity at a high level while minimizing the energy requirements for maintaining such a level of production and it has further been known that it would be desirable to be able to pump from two or more fluid bearing formations simultaneously without modification or repositioning of the pump assembly and without destruction of the pump assembly as a result of entrapped air.

SUMMARY OF THE INVENTION

It is an object of the present invention to provide an improved method and well casing for wells.

Another object is to provide such a method and well casing having particular utility with respect to water wells permitting well production to be maintained at a high level for a given subsurface condition without the necessity of repositioning or otherwise modifying the pump assembly while, at the same time, ensuring that the energy costs in maintaining such production are minimized.

Another object is to provide such a method and well casing which permit fluid to be pumped simultaneously from two or more fluid bearing formations without interferring with the production of either formation and without the destructive effects of air entrapment.

Another object is to provide such a well casing which imparts a partial vacuumatic attraction permitting the extraction of fluid from fluid bearing formations on a more productive and efficient basis than has heretofore been possible.

Another object is to provide such a well casing which operates to draw fluid from two or more fluid bearing formations along substantially discrete paths so as to minimize disruption of the fluid passing along the respective paths.

Another object is to provide such a well casing which is adaptable to wells of virtually any type and which can be employed at minimal cost for use over a long operational life.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
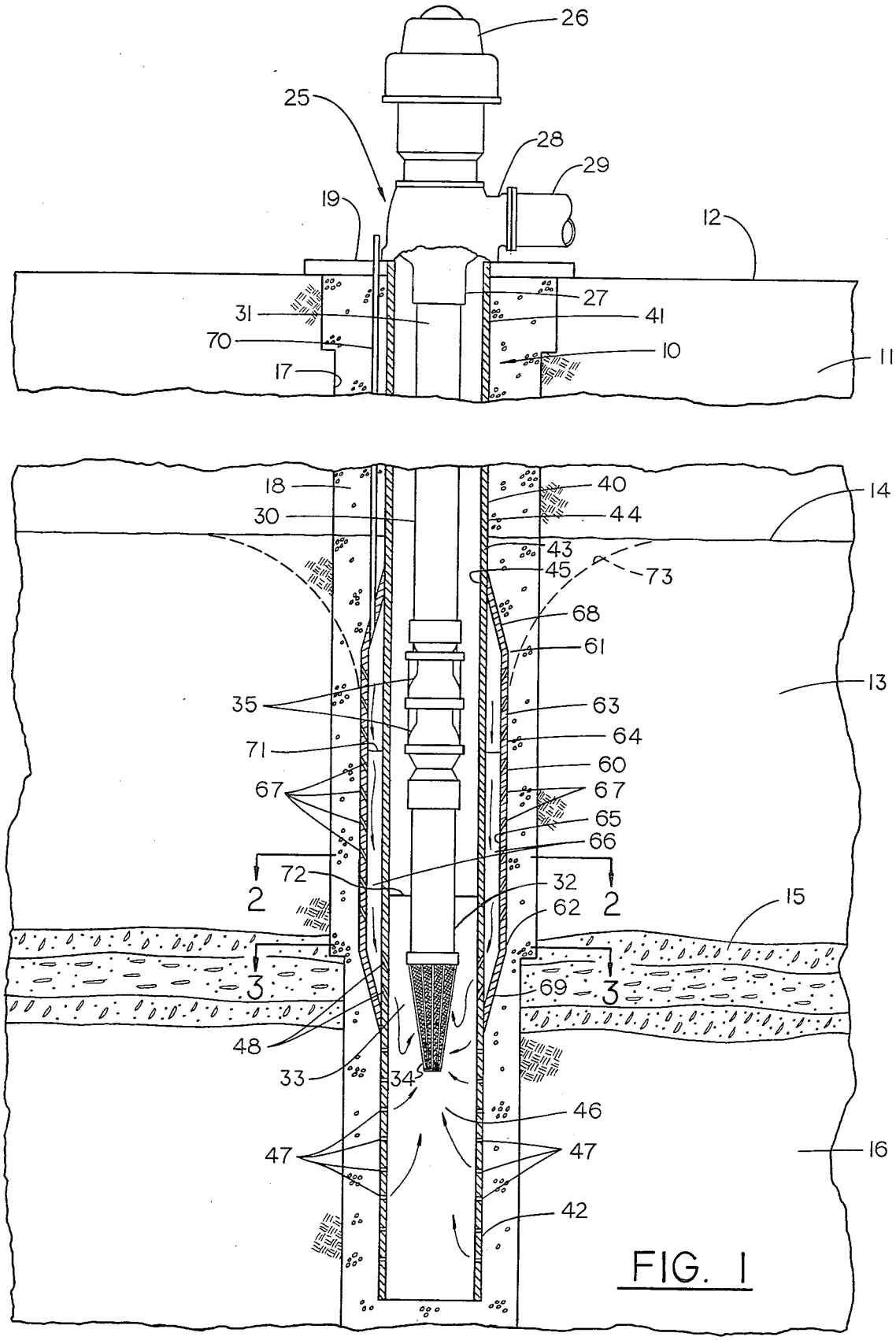
FIG. 1 is a fragmentary vertical section of a well, in this case a water well, illustrating the practice of the method of the present invention and showing the well casing of the present invention in operable position therein.

The well casing of the present invention is generally indicated by the numeral 10 in FIG. 1. For illustrative convenience, the preferred embodiment of the subject invention will be described in connection with a water well. However, it will be apparent that the method and well casing of the present invention can be employed with virtually any type of well. As shown in FIG. 1, the earth is represented at 11 and the earth surface at 12. Located at depth in the earth is an upper fluid bearing formation or aquifer 13. The static water level for the upper aquifer is indicated at 14. This is the level of water when no pumping is taking place in the well. Impervious strata 15 extend beneath the upper aquifer substantially containing the upper aquifer thereabove and virtually preventing percolation of water from the aquifer. A lower water bearing formation or aquifer 16 is below the impervious strata in the earth.

A borehole 17 is formed in the earth extending through the upper aquifer 13, the impervious strata 15 and into the lower aquifer 16. A gravel pack 18 is positioned in the borehole about the well casing 10 as shown in FIG. 1. A mount or pad 19, preferably of concrete, is mounted on the earth surface 12 above and in covering relation to the borehole 17.

A pump assembly is generally indicated at 25 in FIG. 1. The pump assembly includes a pump motor 26 mounted on the pad 19 and having an intake coupling 27 positioned internally of the well casing 10 and a discharge coupling 28 facing laterally of the pump motor and connected in fluid supplying relation to a discharge conduit shown fragmentarily at 29.

The pump assembly 25 has a column or eduction pipe assembly 30 extending downwardly internally of the well casing 10 of the present invention. The column has an upper end portion 31 which is connected in fluid supplying relation to the intake coupling 27 of the pump motor. The column has a lower end portion 32 having a pumping position or intake 33 disposed in a predetermined position hereinafter to be described in greater detail. A strainer 34 is mounted on the intake through which water is pumped into the column 30. The column has a plurality of bowl assemblies 35. The bowl assemblies individually contain impellers, not shown, mounted on a shaft driven by the pump motor 26 to pump water along a path through the strainer 34, the intake 33, upwardly through the column 30, into the intake coupling 27 of the pump motor 26, from the discharge coupling 28 thereof and into the discharge conduit 29.

The well casing 10 of the present invention has a first conduit or casing 40 extending from an upper end portion 41 secured on the pad 19 beneath the pump motor 26 to a lower end portion 42 at depth in the borehole 17 within the lower aquifer 16. The conduit extends about the column 30 substantially concentric thereto. It will be understood that the first conduit is, in reality, composed of a plurality of endwardly interconnected sections forming a casing of the length necessary to reach into the lower aquifer. The length of the casing can be varied as necessary to reach the aquifers to be tapped. This may involve hundreds, and, in some cases, thousands of feet of casing.

The first conduit 40 has a tubular wall 43 preferably of a cylindrical configuration, having an exterior surface 44 and an interior surface 45. The tubular wall bounds and encloses an interior or first passage 46 extending the full length of the first conduit. The lower end portion 42 of the first conduit has a first set of openings 47 extending through the tubular wall 43 so as to establish fluid communication between the gravel pack 18 and the first passage 46 through a substantial length of the lower end portion. It is preferred that the first set of openings be arranged so as to extend for the length of the lower portion of the first casing which is within the lower aquifer. The first set of openings thus establishes fluid communication between the lower aquifer 16 and the first passage 46 of the casing 10. The openings of the first set 47 are positioned in a pattern arranged about the tubular wall. Each opening is preferably, although not necessarily, oriented to form a path substantially right angularly related to the longitudinal axis of the tubular wall.

Figure 3:
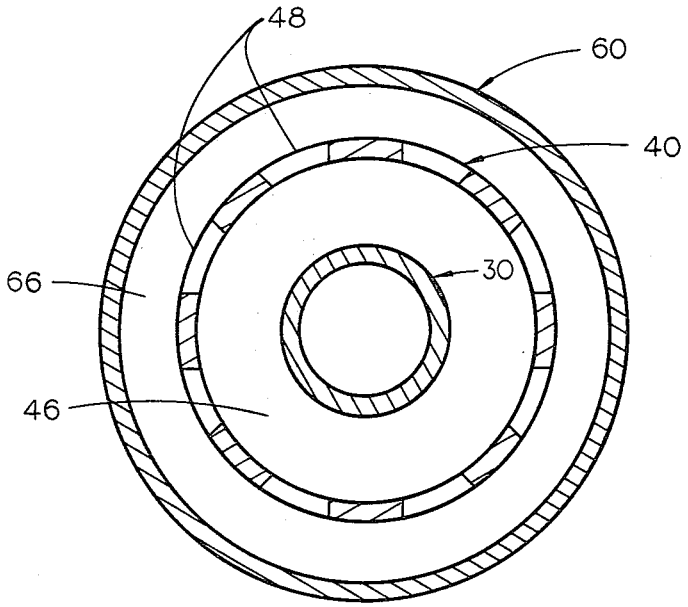
FIG. 3 is a transverse horizontal section taken from a position indicated by line 3—3 in FIG. 1.

A second set of openings 48 extend through the tubular wall 43 of the first conduit 40 in predetermined positions upwardly spaced from the first set of openings 47, as shown in FIG. 1. The openings of the second set preferably individually define paths disposed at angles of approximately 60° with respect to a plane of reference, not shown, right angularly related to the longitudinal axis of the first conduit. The openings of the second set, in effect, form louvers interconnecting the exterior of the tubular wall with the first passage 46 at a position on the casing such as to be at or slightly above the intake 33 of the pump assembly 25 when the casing is mounted in its operating position in the well, as shown in FIG. 1. The openings are convergent in the general direction of the lower end portion 42 of the first conduit. As with the first set of openings, the openings of the second set are arranged in a pattern extending about the tubular wall, as best shown in FIG. 3.

The well casing 10 has a second conduit, housing or casing 60 having an upper end portion 61 and an opposite lower end portion 62. The second conduit has substantially tubular wall 63 having an exterior surface 64 and an interior surface 65. The tubular wall is mounted on the exterior surface 44 of the tubular wall 43 of the first conduit 40 and substantially concentric thereto so as to have a common longitudinal axis. The first and second conduits thus define an interior, chamber or second passage 66 therebetween. As can be visualized in FIGS. 2 and 3, the chamber extends concentrically about the first conduit. As can best be seen in FIG. 1, the second conduit is mounted on the first conduit in a predetermined position relative to the pumping position 33 and the second set of openings 48 of the first conduit. The second conduit is mounted in a position on the first conduit such that the chamber 66 communicates with the second set of openings and extends along the first conduit in a direction away from the lower end portion 42 of the first conduit. The second conduit preferably extends a distance such that when the first conduit is mounted in the borehole 17 with the second set of openings 48 thereof adjacent to the pumping position 33, the second conduit extends upwardly therefrom for a substantial distance into the upper aquifer 13. While this distance as shown in FIG. 1 for illustrative convenience is relatively short, it will be understood that the second conduit 60 and thus the chamber 66 can be and frequently is several hundred feet in length.

Figure 2:
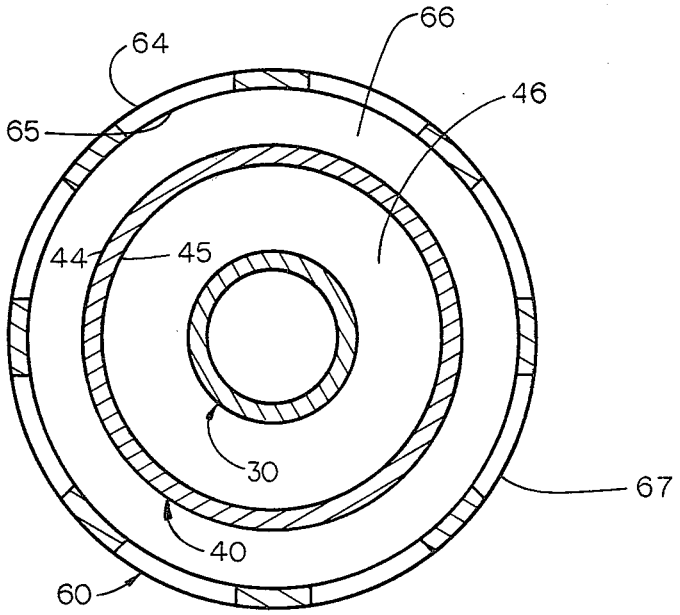
FIG. 2 is a transverse horizontal section taken from a position indicated by line 2—2 in FIG. 1.

A third set of openings 67 extend through the tubular wall 63 of the second conduit 60 for a substantial portion thereof so as to provide maximum communication with the upper aquifer 13. The openings of the third set are arranged in a pattern extending about the tubular wall 63, as shown in FIG. 2. Each opening preferably defines a path disposed at approximately a 60° angle with respect to a plane of reference, not shown, right-angularly related to the common longitudinal axis of the first and second conduits. The openings are convergent in the direction of the second set of openings 48. The third set of openings is preferably spaced from the second set of openings in a direction extending away from the lower end portion 42 of the first conduit, as best shown in FIG. 1. The tubular wall 63 of the second conduit has an upper cone or convergent wall 68 which is mounted on the first conduit and an opposite lower cone or convergent wall 69 which is mounted on the first conduit. Thus, as can best be seen in FIG. 1, the lower convergent wall is, in effect, disposed in feeding relation to the second set of openings 48. The second passage 66 is thus in fluid communication with the upper aquifer 13 through the third set of openings 67 and in fluid communication with the first passage 46 through the second set of openings 48.

A vent pipe 70 is mounted on the upper convergent wall 68 in communication with the chamber 66 of the second conduit 60 and extends substantially parallel to the first conduit 40 for the entire length thereof. Thus, when the casing 10 is mounted in a well as shown in FIG. 1, the vent pipe extends through the gravel pack 18 and the pad 19 to communicate with the atmosphere above the earth surface 12.

For illustrative convenience, the water level within the second passage 66 when the pump assembly 25 is in operation is indicated at 71. Similarly, the water level within the first passage when the pump assembly is in operation is indicated at 72. It is believed that when the pump assembly 25 is in operation, the static water level 14 is drawn down adjacent to the well casing and thus forms a cone of depression generally indicated in phantom lines at 73.

OPERATION

The operation of the described embodiment of the subject invention is believed to be clearly apparent and is briefly summarized at this point. It will be understood that positioning of the well casing 10 and the pump assembly 25 in the borehole 17 is determined in advance by logging of the well using appropriate logging methods. Where the well casing 10 is to be employed to pump fluid from a pair of fluid bearing formations, the casing is positioned in the borehole 17 so as to extend through the upper fluid bearing formation 13 and into the lower fluid bearing formation 16. The pump assembly 25 is preferably positioned so that the intake 33 is adjacent to the lower fluid bearing formation, as shown in FIG. 1. However, the intake in other instances can be positioned below or above this position so long as it is beneath the water level 72 in the first passage. The second conduit 60 is positioned so as to extend into the upper fluid bearing formation and preferably to be disposed so that the second set of openings 48 are disposed adjacent to the intake 33, also as best shown in FIG. 1.

It will be understood, that the well casing 10 of the present invention can be employed to pump fluid from virtually any number of fluid bearing formations as well as just a single formation. As will hereinafter be described in greater detail, the partial vacuumatic attraction believed to be achieved within the chamber 66 during operation can be employed, in effect, to draw fluid from a single fluid bearing formation in substantially the same manner as shown in FIG. 1 if it is visualized that there is no lower fluid bearing formation 16. Alternatively, the casing 10 can be so constructed and positioned that the second conduit 60, and thus the chamber 66, extend through the fluid bearing formation as shown in FIG. 1, but continue for a substantial distance therebelow so as to gain the greatest possible benefit from the natural gravitational flow of fluid downwardly within the chamber to draw the fluid from the fluid bearing formation.

Returning to the arrangement shown in FIG. 1, the well casing 10 and pump assembly 25 cooperate to pump water from both the upper aquifer 13 and the lower aquifer 16. Water from the lower aquifer flows through the first set of openings 47 into the first passage 46 of the first conduit 40 as water is pumped through the intake 33 and up the column 30. Simultaneously, water flows from the upper aquifer, through the gravel pack 18, through the third set of openings 67, downwardly in the second passage 66 through the second set of openings 48 and into the first passage 46 of the first conduit 40. At that point, the water is drawn upwardly through the strainer 34 and into the column for pumping to the earth surface. It is believed that the downward movement of water within the chamber 66, which is free falling in most instances for at least a portion of the length of the chamber, creates a partial vacuumatic attraction within the chamber and formation which draws or sucks water from the aquifer.

Thus, it will be seen that the pump assembly is permitted to pump water from both the upper aquifer and lower aquifer simultaneously without disturbing the flow from either since the fluid is moved along discrete passages until it reaches the pumping position 33. Since the water moving along the second passage 66 is isolated from the first passage 46 other than below the water level 72 by openings 48, air from the atmosphere in the first passage cannot be entrapped by falling water. Thus, air is not introduced to the pump assembly and the damage which otherwise would result is avoided. Similarly, it will be seen that when the available water in either of the aquifers begins to diminish or, in fact, the flow terminates, the pump assembly 25 can continue to operate to pump water from the other aquifer without repositioning of the pump assembly and without any disruption of the flow from the aquifer which is still producing. This is true whether it is the upper or lower aquifer which stops producing.

In some instances, it is desired to treat the casing 10 with an acid solution or a similar treating solution such as to clean the sets of openings 47, 48 and 67. For this purpose, the treating solution can be deposited down the vent pipe 70 and is received gravitationally within the second passage or chamber 66 of the second conduit 60. From the chamber the solution can flow into the first passage 46 of the first conduit 40 through the second set of openings 48.

In other instances, it is desirable to backflush the well. This can be done in conjunction with the use of the treating solution described above, or independently thereof. Backflushing is accomplished by reversing the direction of pumping of the pump assembly 25 to force water down the column 30, out through the intake 33 and into the first passage 46. Continued operation causes water to be pumped in the reverse direction along the first and second passages and outwardly through the first, second and third sets of openings 47, 48 and 67 respectively and into the upper and lower aquifers. The vent pipe 70, in this case, operates to allow the escape of air or gas from the casing. The backflushing operation is thus facilitated by releasing the back pressure created thereby.

Therefore, the method and well casing of the present invention afford the capability of substantially increasing the production of wells while reducing the cost of maintaining such well production and permit the simultaneous pumping of fluid from two or more fluid bearing formations in such a manner that pumping can be continued without modification of the well even when one of the fluid bearing formations eventually stops producing.

Although the invention has been herein shown and described in what is conceived to be the most practical and preferred method and apparatus, it is recognized that departures may be made therefrom within the scope of the invention, which is not to be limited to the illustrative details disclosed.

Having described my invention, what I claim as new and desire to secure by Letters Patent is:

1. In a water well having a hole extending from the earth surface through an upper aquifer and into a lower aquifer, a pump assembly mounted in the hole extending from a position within the lower aquifer to the earth surface and operable to pump water from said position to the earth surface, a casing comprising a first conduit mounted in the hole extending from within the lower aquifer to the earth surface substantially concentric to the pump assembly and having a first set of openings extending therethrough adjacent to said position and a second set of openings extending therethrough upwardly disposed with respect to the first set; and a second conduit mounted on the first conduit substantially concentric thereto forming a chamber circumscribing the first conduit communicating with said second set of openings and a third set of openings extending through the second conduit nearer to the upper aquifer than said second set of openings of the first conduit to establish a path for fluid movement from the upper aquifer through the third set of openings, the chamber, the second set of openings and to said position for pumping by the pump assembly.

2. The casing of claim 1 wherein the second set of openings in the first conduit are upwardly disposed with respect to said position in the lower aquifer such that operation of the pump assembly creates a vacuumatic attraction along said path for fluid movement to draw fluid from the upper aquifer to said position.

3. The casing of claim 2 wherein the second conduit has a lower portion below the third set of openings and spaced outwardly from the second set of openings of the first conduit convergent upon the first conduit to direct fluid through the second set of openings from said chamber.

4. The casing of claim 2 wherein a pipe is mounted on the second conduit in communication with the chamber thereof remote from the second set of openings of the first conduit and extends to the earth surface to permit displacement of air from the chamber upon operation of the pump assembly in reverse to pump fluid from the pump assembly within the first conduit to force fluid in a reverse direction along said path of fluid movement.

5. A method for pumping water simultaneously from upper and lower aquifers below the earth surface, the method comprising:

A. forming a hole extending from the earth surface through the upper aquifer and into the lower aquifer;

B. mounting a casing in the hole having a first passage communicating with the lower aquifer and a second passage communicating with the upper aquifer and said first passage; and C. securing a pumping assembly in the hole extending from a pumping position within the first passage adjacent to the position of communication of said first and second passages and operable to pump water from said pumping position.

6. The method of claim 5 wherein said securing step includes securing the pumping assembly in the hole so as to place said pumping position below the upper aquifer.

7. A casing for a well comprising a conduit, having a wall bounding a longitudinal passage and formed from a plurality of interconnected, substantially longitudinally aligned sections, adapted to be mounted in a borehole in communication with a fluid bearing formation and having openings extending through the wall thereof in a predetermined location to interconnect said longitudinal passage with the exterior of the conduit in fluid conducting relation; and a housing having a wall mounted on the wall of the conduit to define a chamber between said walls substantially concentric to said longitudinal passage of the conduit and said wall of the housing extending from an end portion, enclosing said openings of the conduit to establish fluid communication between said chamber and said first passage, to an opposite end portion remote therefrom, said housing having openings extending through the wall thereof to interconnect said chamber with the exterior of the housing in fluid conducting relation only at locations longitudinally spaced along the conduit from said openings of the conduit.

8. The casing of claim 7 wherein the housing is elongated longitudinally along the conduit and said end portion of the wall of the housing enclosing said openings of the conduit converges upon the conduit about said openings of the conduit and is imperforate so as to establish a sealed path of fluid transfer from the openings of the housing to the openings of the conduit.

* * * * *

UNITED STATES PATENT AND TRADEMARK OFFICE

CERTIFICATE OF CORRECTION

PATENT NO. : 4,382,470

DATED : May 10, 1983

INVENTOR(S) : Larry C. Naffziger

It is certified that error appears in the above-identified patent and that said Letters Patent is hereby corrected as shown below:

Column 4, line 18, between "has" and "sub-" insert ---a---.

Signed and Sealed this

*Sixth* Day of *September 1983*

[SEAL]

*Attest:*

GERALD J. MOSSINGHOFF

*Attesting Officer*

*Commissioner of Patents and Trademarks*